US005271420A

United States Patent [19]

Park

[11] Patent Number: 5,271,420

[45] Date of Patent: Dec. 21, 1993

[54] WIGS WITHOUT HEAD CAP MADE OF WEFTS OF SINGLE LINE STITCH

[75] Inventor: Heon S. Park, #148-10, Junggock 4-Dong, Seongdong-Ku, Seoul, Rep. of Korea

[73] Assignees: Heon-Sik Park; Dongan Co., Ltd., both Seoul, Rep. of Korea

[21] Appl. No.: 7,957

[22] Filed: Jan. 22, 1993

[30] Foreign Application Priority Data

Nov. 23, 1992 [KR] Rep. of Korea ..... 92-22044

[51] Int. Cl.[5] ..... A41G 3/00

[52] U.S. Cl. ..... 132/53; 132/56

[58] Field of Search ..... 132/53, 54, 56, 201

[56] References Cited

U.S. PATENT DOCUMENTS

| | | | |
|---|---|---|---|
| 2,393,858 | 1/1946 | Gordon | 132/53 |
| 3,688,779 | 9/1972 | Grew | 132/53 |
| 3,734,105 | 5/1973 | Borghese | 132/54 |
| 3,788,332 | 1/1974 | Abbott et al. | 132/54 |
| 3,822,712 | 7/1974 | Ostenssen | 132/53 |
| 3,834,403 | 9/1974 | Ahn | 132/53 |
| 3,835,867 | 9/1974 | Molinario | 132/53 |
| 3,910,291 | 10/1975 | Kim | 132/53 |
| 4,150,678 | 4/1979 | Photopulous | 132/53 |

*Primary Examiner*—Gene Mancene
*Assistant Examiner*—Frank A. LaViola

[57] ABSTRACT

A wig is provided having a single line weft and no head cap. Hairs of the wig are joined by a single line of stitch, folded by heating and coated with an adhesive. A linear lace of two or three lines of hairs is fixed to a vinyl sheet. The single weft of wig hair is tied to the linear lace with a binding line. The wig is light in weight due to a single line of weft and the direction of curl can be easily changed. The weft of narrow width will not damage the scalp and suits well with the hair of the wearer.

4 Claims, 7 Drawing Sheets

FIG. 1 PRIOR ART (A)
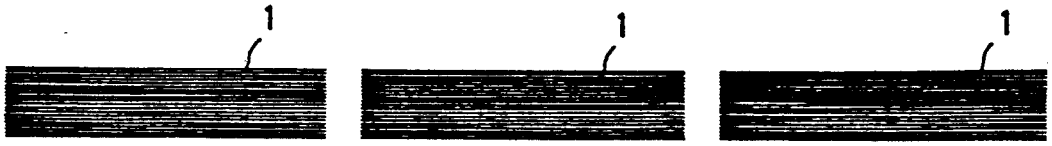
FIG. 1 PRIOR ART (B)
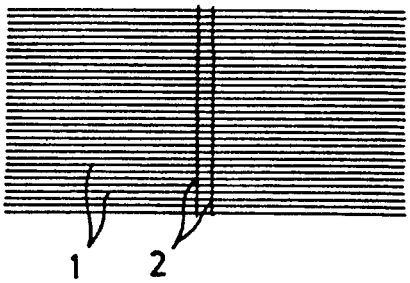
FIG. 1 PRIOR ART (C)
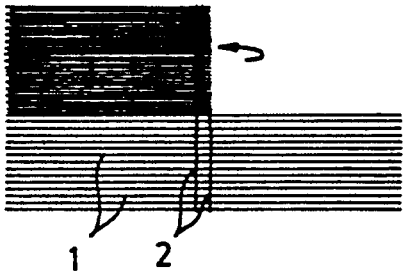
FIG. 1 PRIOR ART (D)
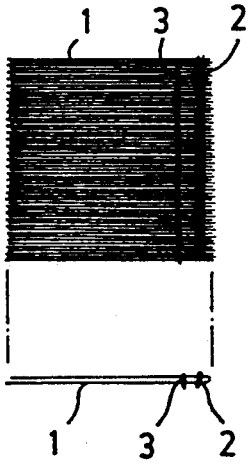
FIG. 1 PRIOR ART (E)
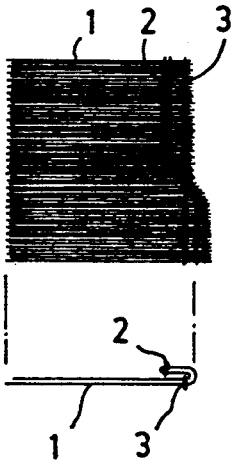
FIG. 1 PRIOR ART (F)
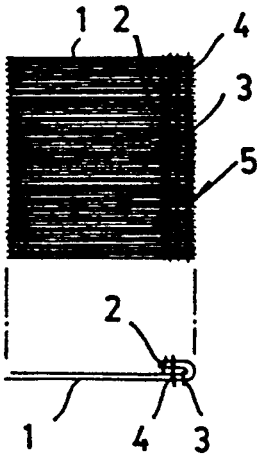

FIG. 15(A)
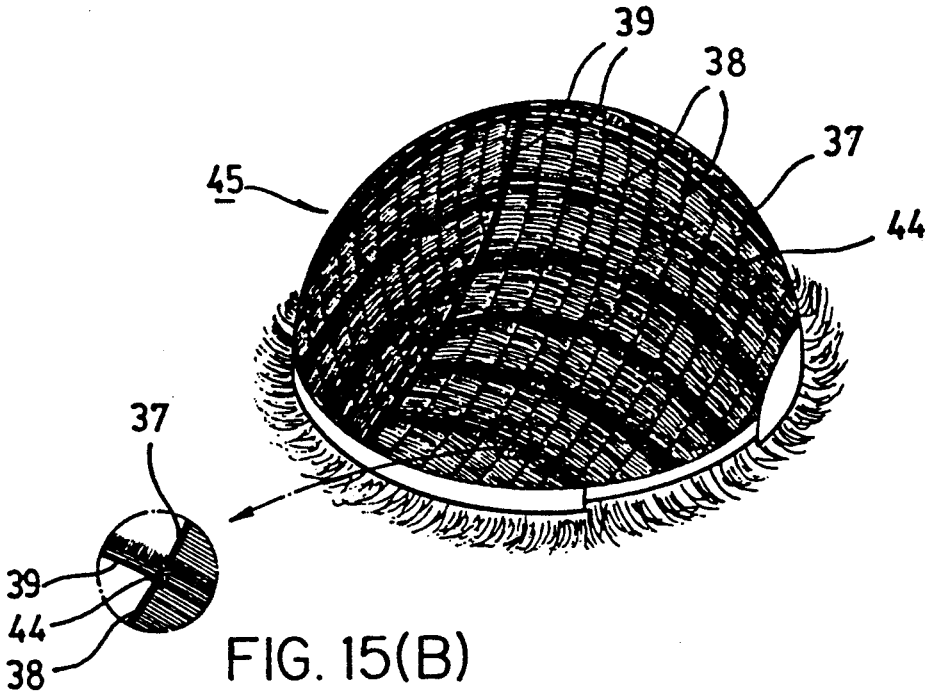
FIG. 15(B)
FIG. 16
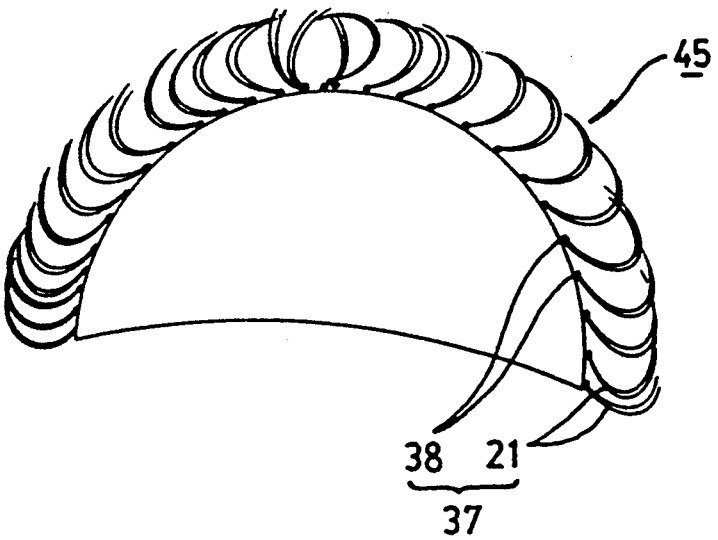

WIGS WITHOUT HEAD CAP MADE OF WEFTS OF SINGLE LINE STITCH

FIELD OF THE INVENTION

This invention relates to a wig without head cap and made of a single wefted hair and a manufacturing method thereof. In particular, this invention relates to a single weft made of a single line stitch, whereby the wig's hair looks like natural human hair, the wig suits well the original hair of the wig wearer. The wig is comfortable to wear because it is much lighter than the conventional wig which reduces the pressure on the scalp and ventilation of the wig is promoted which enables the wearer to wear the wig for a long time.

BACKGROUND OF THE INVENTION

Wigs are made by two kinds of manufacturing methods, hand-made and machine-made.

A hand-made wig is made by tying the hairs in a net, giving it the particular advantage of looking like natural human hair.

However, it is very hard to mass produce hand-made wigs in view of the fact that great number of working hours are spent in tying the hairs in a net by hand one by one. A machine-made wig has the advantage that it can be mass-produced through a series of manufacturing processes though the quality is not equal to that of a hand-made wig.

U.S. Pat. No. 3,910,291 discloses such machine-made wigs.

The manufacturing process of such machine-made wigs is shown in the accompanying Figures, in which hairs(1) are cut into a predetermined length(see FIG. 1A) and sewn by a sewing machine forming a first pair of double stitch lines(3)(see FIG. 1B). Then, one side of the stitched hairs(1) is folded over on top of the other side along the centerline between the first pair of double stitch lines(2)(see FIG. 1C). The folded hairs(1) are sewn with a second single stitch line(3)(see FIG. 1D). Thereafter, the first double line section is folded over the second single stitch line section(see FIG. 1E). The folded hair(FIG. 1E) is sewn with a third single stitch line(4) (see FIG. 1F).

Wigs(7) as shown in FIG. 3 are made of the hairs(-FIG. 2) each of which includes three times sewn weft(5) coated with urethane adhesive. To provide a finished wig(7), each hair(FIG. 2) arranged in the shape of head is sewn with a fourth single stitch(10) on a head cap(8) which comprises an end lace to which a net(**8*a*), lace(8*b*) and a stretchy band(8*c*) are connected(see FIG. 3**).

To sew the hair(FIG. 2) on the head cap(8) in a predetermined regular interval the head cap(8) is preaffixed to a head shaped P.V.A.(Poly Vinyl Alcohol) film sheet so that the shape of the head cap(8) itself can be maintained. Thereafter, a wig is finished by sewing the hair(FIG. 2) one by one. The hairs(FIG. 2) of such a conventional wig(7) has a relatively wide weft(5) with three times stitched lines(2)(3)(4).

That is, the hair(FIG. 2) has a relatively wide root. With the weft(5), when the hairs(FIG. 2) are curled, the curled area is formed not adjacent to, but remote from the weft(5) which is the root. Therefore, the curls are not movable in any direction so that the shape of the wigs will not be changed readily. Furthermore, the root of each hair(FIG. 2) becomes flat and wide, making the section which is adjacent to the root stiff.

Therefore, the curled sections extend only in the sewn direction and the combing of the hairs(FIG. 2) in other directions is not readily achieved.

This wide weft(5), when worn on the head, contacts flatly with the scalp(see FIG. 4), exerting pressure on the head. In addition, contacting the scalp by thick wefts(5) and stitch lines(10) cause pain to the scalp. Therefore, the conventional wig has a problem that the wearer cannot wear the wig for a long time.

SUMMARY OF THE INVENTION

An object of the present invention is to eliminate the above problems, by providing a wig which has no head cap, whereby the manufacturing processes of the wigs will be shortened, the weight of the wig will be lightened and pressure on the head of the wig wearer will be reduced, making it possible to wear the wig for a long time.

Another object of the present invention is to provide a wig including a single line weft which does not appear through hairs, whereby the wig will have a good ventilation and the direction of the hair of the wig can be changed readily and whereby the wig will have the same effect as the natural hair, thus maximizing the wearing effect of the wig.

Still another object of the present invention is to provide a method of manufacturing of the wig embodying the above objects.

BRIEF DESCRIPTION OF THE DRAWINGS

FIGS. 1A–1F show the manufacturing process of the conventional cap-provided wig;

FIGS. 15A and 15B are perspective views showing the wig of the present invention being turned inside out; and FIG. 16 a view outlining the finished wig of the present invention.

DETAILED DESCRIPTION OF THE INVENTION

Figure 2:
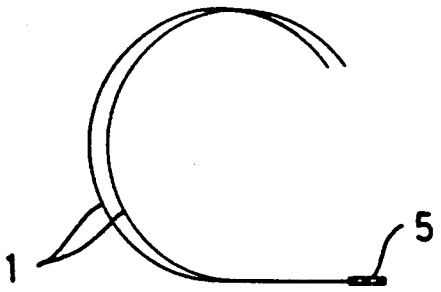
FIG. 2 PRIOR ART
FIG. 2 shows curls of the conventional hair of the wig.
Figure 3:
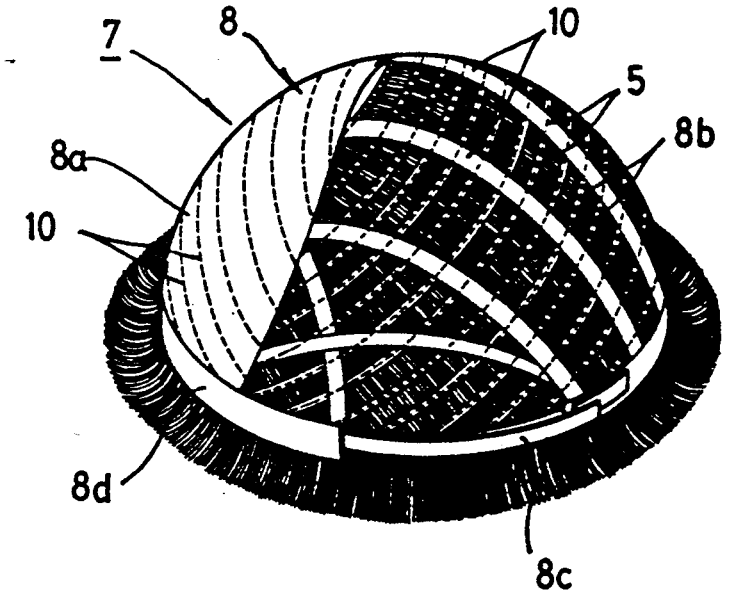
FIG. 3 PRIOR ART
FIG. 3 is a perspective view of the conventional wig which is turned inside out.
Figure 4:
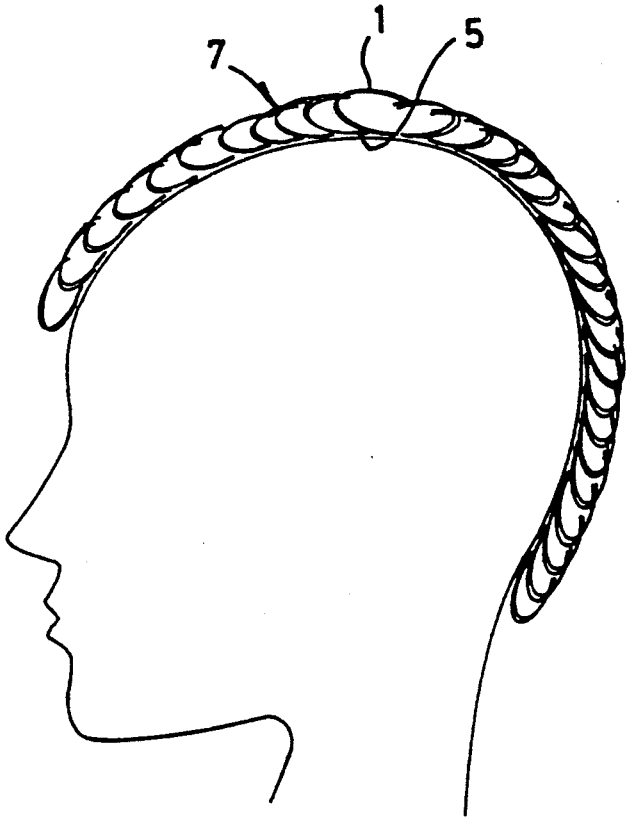
FIG. 4 PRIOR ART
FIG. 4 shows the wearing condition of the conventional wig.
Figure 5:
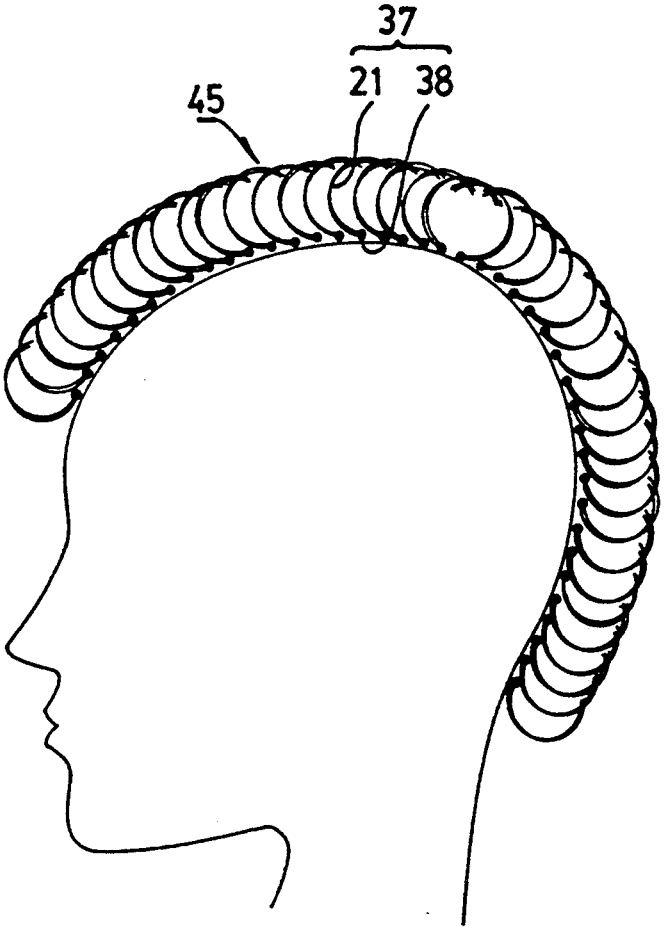
FIG. 5 shows the wearing condition of the wig of the present invention.
Figure 6:
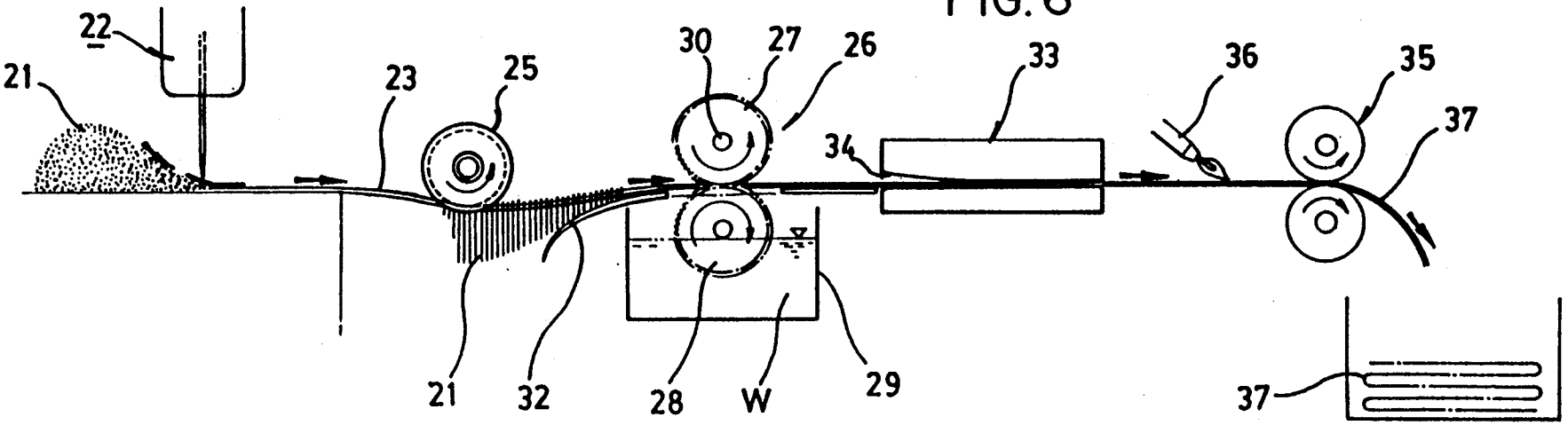
FIG. 6 is a side view showing the manufacturing process of a hair section embodying the wig of the present invention.
Figure 7:
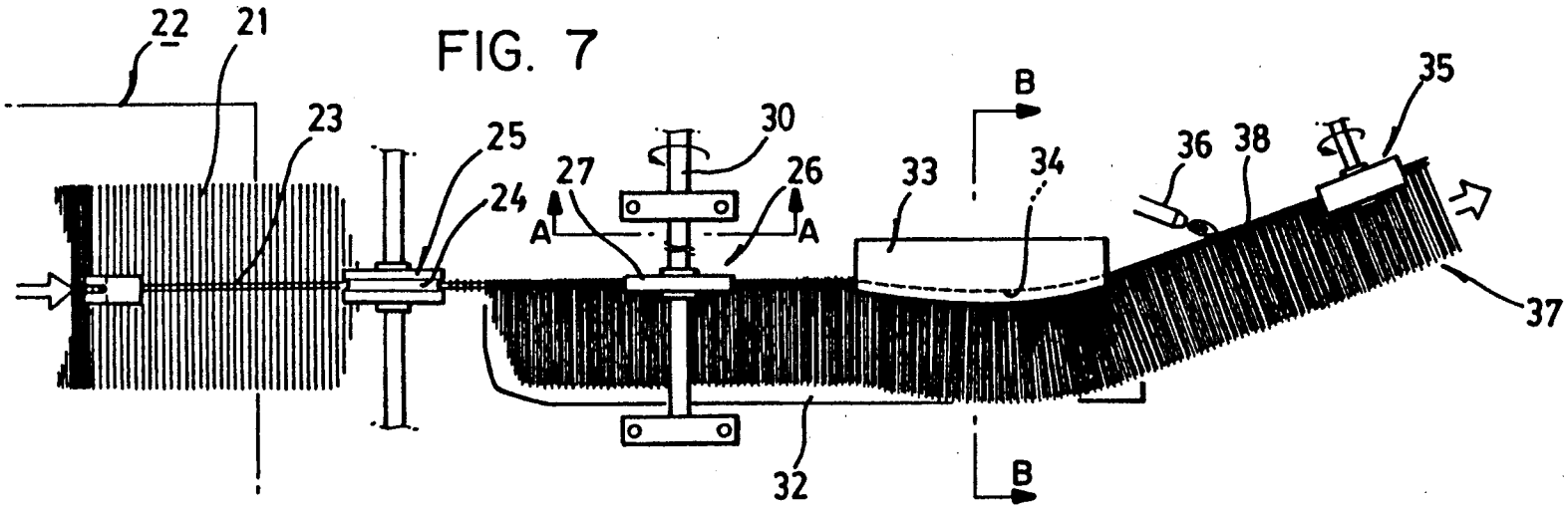
FIG. 7 is a plan view showing the manufacturing process of the wig of the present invention.

In FIGS. 6 and 7, a plurality of hairs 21 are cut into a predetermined length and supplied to a sewing machine (22) and there after sewed in a line with a stitch line (23).

Figure 8:
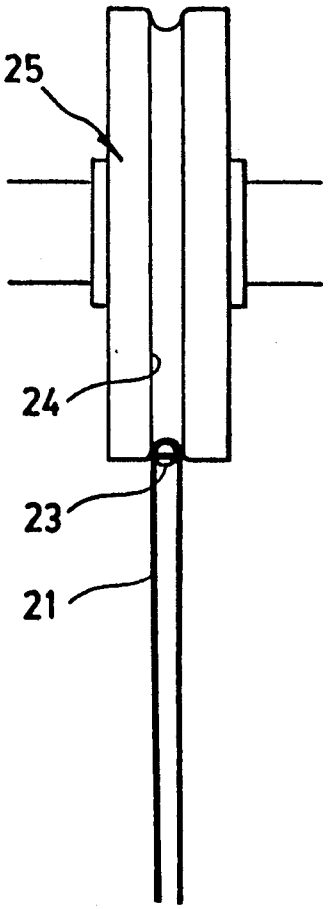
FIG. 8 shows the operation of a first fold setting roller used in the fold process of the hair of the wig of the present invention.

The stitched hairs 21 pass a setting roller 25 having a peripheral groove 24 by which the yarns 21 are folded along the stitch line 23. The temperature of setting roller 25 is maintained at approximately 80° C. by an electric heat device so that the stitched hairs passing over the periphery groove 24 may be heated and folded well along the stitch line 23. Accordingly, the folded condition of the stitched hairs will be kept well (see FIG. 8). The rotating speed of the setting roller 25 is the same as the operating speed of the sewing machine 22.

Figure 10:
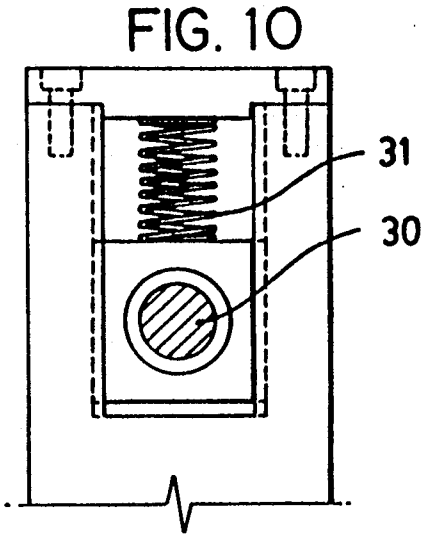
FIG. 10 is a sectional view taken along line A—A of FIG. 7.

After passing the setting roller 25, the folded hairs 21 go through adhesion and resetting processes. Adhesion station 26 comprises toothed driving roller 27 and driven roller 28 which tense the stitch line 23 on the hairs 21. The driving roller 27 is mounted on a shaft 30 powered by a motor (not shown). The shaft 30 bears against a spring 31 (see FIG. 10) so that the rotating force of the driving roller 27 may be transmitted to the driven roller 28. With this arrangement, the stitch line 23 is squeezed between the rollers 27 and 28 is effectively tensioned. The shaft 30 is connected to an output shaft of the motor with universal joint. With this arrangement, the shaft 30 can readily rotate the driving roller 27 regardless of the force of the spring 31.

The driven roller 28 is partially immersed in an adhesive storing can 29 so as to apply adhesive W to the stitch line 23 and folded section of the hairs while rotating together with the driving roller 27. The teeth of the rollers 27, 28 facilitate applying of the adhesive W therebetween. The adhesive W is applied around the stitch line 23 uniformly, thus being applied uniformly to the folded hairs section (see FIG. 6).

A guide plate 32 is mounted around the adhesion station 26 to change the folded hairs 21 from a longitudinal state to a horizontal state so that the adhesive may be applied only to the folded sections of hairs 21. The guide plate 32 extends to a heating arranging apparatus 33 constituting a resetting process in which the folded, adhesive-applied sections of the hairs 21 are arranged again.

Figure 9:
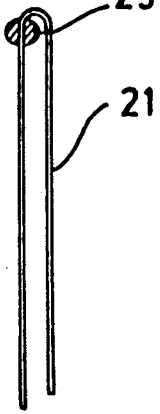
FIGS. 9A and 9B show the hair sewn by a stitch line and the folding state of the yarns, respectively.
Figure 9:
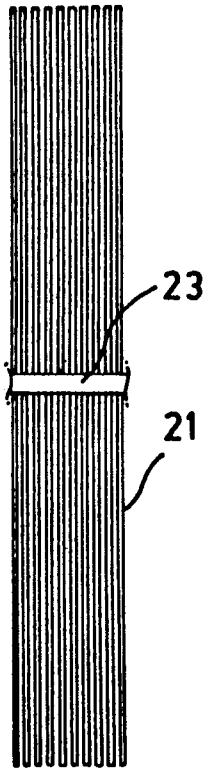

That is, the hairs 21 having passed the setting roller 25 are folded roughly around the stitch line 23 but are not folded into an accurate U-shape (see FIGS. 9A, 9B). Accordingly, the roughly folded section of the hairs must be rearranged.

With the heat arranging apparatus 33, the roughly U-shaped folded hair section is accurately folded along the stitch line 23.

Figure 11:
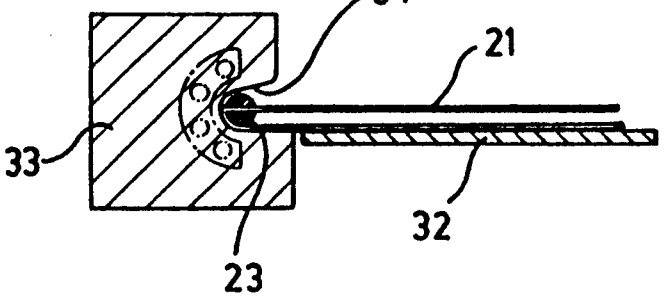
FIG. 11 is a sectional view taken along line B—B of FIG. 7.

The heat arranging apparatus 33 has an approximately U-shaped guide groove 34 (see FIG. 6) and the temperature thereof is maintained approximately at 80° C. The U-shaped groove 34 has a relatively wide inlet portion and narrows gradually. Accordingly, the outlet portion of the U-shaped groove 34 has approximately the same diameter as the outside diameter of the stitch line 23 (see FIG. 11). With this arrangement, loops which are folded larger than the diameter of stitch line 23 come near the stitch line 23 while passing through the guide groove 34 and are reset by heating. At the same time, the stitch line to which an adhesive has been applied is flattened completely and the hairs are folded completely along the stitch line 23.

A tension station 35 is provided to carry the stitch line 34 in close relation to the inner wall of the guide groove 34 of the heat arranging apparatus 3. The tension station 35 comprises a pair of rollers which are composed of such material as not to damage the hairs, stitch line and adhesive. One of the rollers is powered by a motor and serves as a tension means. The rotating speed of the tension rollers is the same as those of the driving and driven rollers 27, 28. With these arrangements, the supplying speed of the hairs 21 to the sewing machine 22 is the same as the tensioning speed of a completed hair section 37 passing the heat arranging apparatus 33, whereby the completed hair section 37 can be manufactured continuously.

The folded, adhesive-applied section of the completed hair section 37 joined by and folded along the single stitch line 23 constitutes a weft 38. Accordingly, the weft 38 has a very small width and thickness. A softening agent is sprayed to the weft 38 with a spray device 36 disposed between the heat arranging apparatus 33 and the tensioning station 35, whereby the scalp or hair of the wig wearer will be protected. The adhesive used in this invention is such that it will not harm the human body and will have a high degree of adhesive strength. The softening agent is also such that it will not harm the human body.

With the completed hair section 37 of this invention, a wig similar to the hair of the human body can be manufactured without using the conventional head cap.

Figure 12:
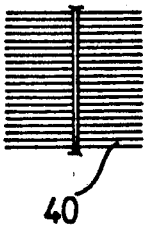
FIGS. 12A–12C show the manufacturing process of linear lace.
Figure 12:
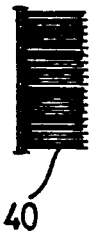
Figure 12:
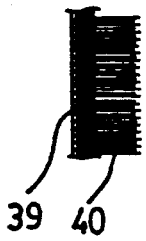
Figure 13:
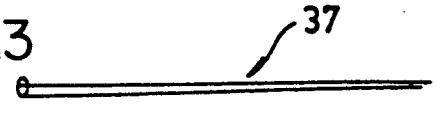
FIGS. 13A and 13B are views comparing the hair section with the linear lace of the present invention.
Figure 13:
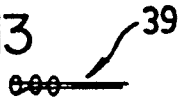
Figure 14:
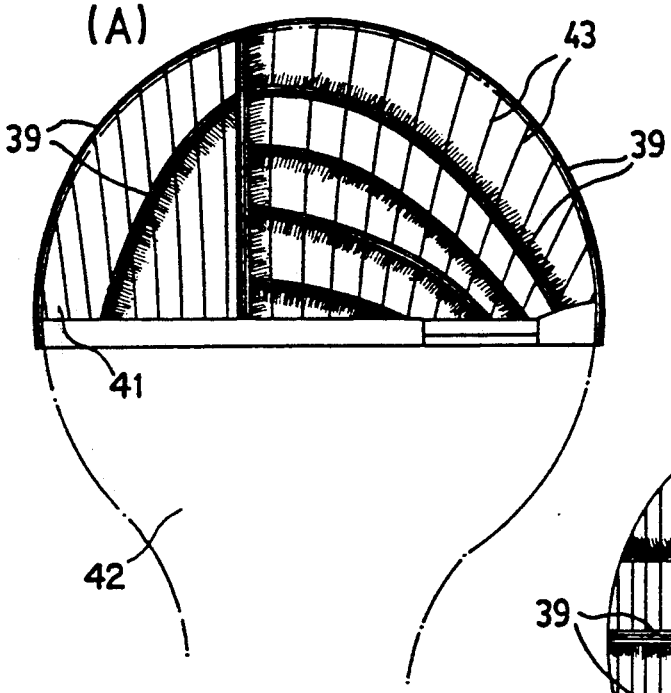
FIGS. 14A–14C are views showing the manufacturing process of the wig provided with the linear lace and hair section of the present invention.
Figure 14:
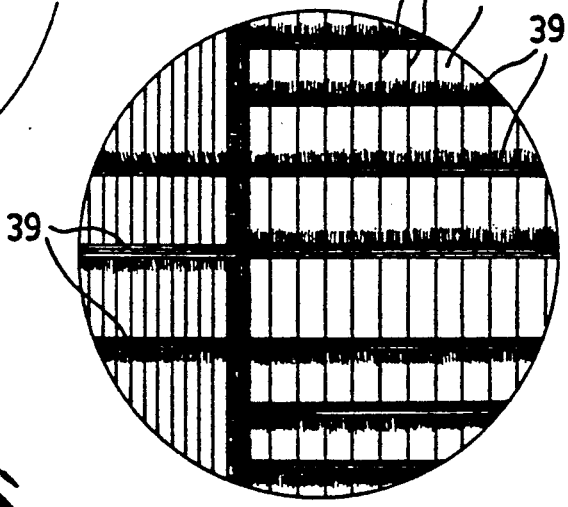
Figure 14:
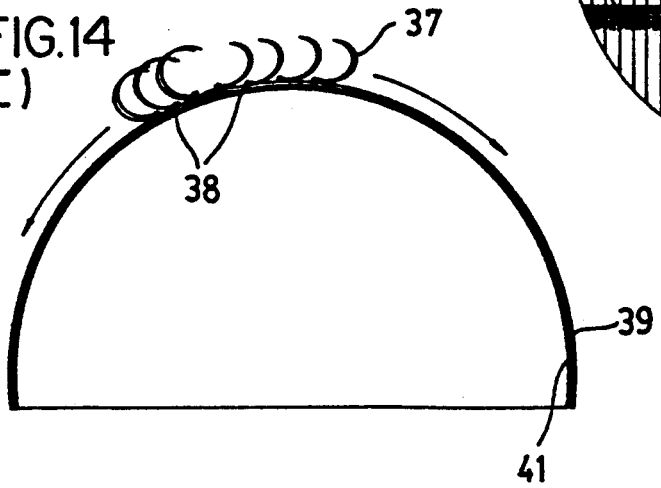

To join the completed hair sections 37 of this invention, a linear lace 39 comprising two or three lines of hairs 40 is used. As shown in FIG. 12, the hairs 40 of the linear lace 39 are much shorter than the wig hairs 21. The manufacturing method of the linear lace 39 is the same as that for the hair section of the wig. That is, the hairs 40 are sewn with a line of stitches at the middle portion thereof. One half of the stitched hairs 40 is folded over the other half, sewn with one or two lines of stitches and coated with an adhesive.

The shorter hairs 40 serve as the inner hair of the wig. In some cases, hairs of linear lace may have the same length as that of the hair of the wig for the wig to have abundant hair. In this invention, the use of the hairs 40 itself may improve the quality of wig regardless of the length of the hairs 40. Furthermore, instead of linear lace comprising two or three lines, a smooth, thin and narrow fabric belt can be used.

The manufacturing method of the wig 45 is described below.

As in the conventional method, a vinyl sheet 41 in a head shape is put on a wooden model. Linear laces 39 are fastened to corresponding drawing lines (not shown) and wefts 38 are tied to the linear laces 39 in accordance with weft fastening sign lines 43 (see FIGS. 15A and 15B. As shown in FIG. 15, with only tie lines, wefts 38 of hair sections 37 are fastened to linear laces 39 without the necessity of the conventional head cap.

The tie lines 44 are fastened by using the conventional sewing machine or manually.

The finished wig 45 is obtained by removing the vinyl sheet 41. In this invention, since the weft is made of a single line, curls of the hairs can be formed adjacent to the weft. Since the single line weft or root of the hairs is rounded and has a very narrow width, the hairs of the wig can move freely and the direction of the curls can be changed readily, which increases the wearing effect of the wig. Since the single line weft has a narrow width and the surface of the adhesive has been smoothed by a softening agent, a feeling of contact with the scalp is good, whereby a feeling of wearing of the wig will be improved. Since the weight of the hair section is light, the head of the wearer is not pressed, whereby the wearer does not tire of wearing the wig even when he wears the wig of this invention for a long time.

What is claimed is:

1. A wig without a head cap and having a single line weft, comprising:

linear lace arranged in a head shape and having hairs sewn with a single line of stitches at a middle portion thereof, one half of the stitched hairs being folded over the other half of the stitched hairs, the hairs having been folded being again sewn with at least one line of stitches; and a weft of a hair section of a wig fixed to the linear lace at an angle, the weft being tied to the linear lace with a tie line at a crossing section thereof.

2. The wig without a head cap and having a single line weft according to claim 1, wherein the weft of the hair section of the wig is made of a single line of stitches.

3. The wig without a head cap and having a single line weft according to claim 1, wherein the linear lace is made of at least two lines of stitches and has short hairs like the inner hair.

4. The wig without a head cap and having a single line weft according to claim 1, wherein the length of the hairs of the linear lace is the same as that of the hairs of the hair section of the wig.

* * * * *